US006408939B1

(12) United States Patent
Sugimoto et al.

(10) Patent No.: US 6,408,939 B1
(45) Date of Patent: Jun. 25, 2002

(54) DOUBLE HEAT EXCHANGER

(75) Inventors: Tatsuo Sugimoto, Okazaki; Satomi Muto, Nishikasugai-gun; Takaaki Sakane, Nagoya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/536,495

(22) Filed: Mar. 27, 2000

(30) Foreign Application Priority Data

Mar. 30, 1999 (JP) ..... 11-089792
Aug. 27, 1999 (JP) ..... 11-242097

(51) Int. Cl.[7] ..... F28D 21/00; F28F 13/00
(52) U.S. Cl. ..... 165/140; 165/135; 165/149
(58) Field of Search ..... 165/135, 140, 165/149

(56) References Cited

U.S. PATENT DOCUMENTS 5,172,752 A * 12/1992 Goetz, Jr. ..... 165/41
5,509,199 A * 4/1996 Beamer et al. ..... 29/890.07
5,992,514 A * 11/1999 Sugimoto et al. ..... 165/135
6,000,460 A * 12/1999 Yamanaka et al. ..... 165/67
6,012,512 A * 1/2000 Ghiani ..... 165/140
6,213,196 B1 * 4/2001 Ozaki et al. ..... 165/140
6,237,676 B1 * 5/2001 Hasegawa et al. ..... 165/67

FOREIGN PATENT DOCUMENTS

JP A-5-172476 7/1993
JP A-10-170184 6/1998

* cited by examiner

*Primary Examiner*—Allen Flanigan
(74) *Attorney, Agent, or Firm*—Harness, Dickey and Pierce, P.L.C.

(57) ABSTRACT

In a double heat exchange, a radiator and a condenser are integrated through a side plate for reinforcing the radiator and the condenser, and a longitudinal dimension of condenser tubes is made smaller than a longitudinal dimension of radiator tubes. Therefore, a core area of the condenser becomes smaller than that of the radiator. Thus, heat-exchanging capacity of the condenser is restricted from being increased more than a necessary capacity, and size and performance of the double heat exchanger are restricted from being increased more than necessary conditions.

25 Claims, 15 Drawing Sheets

DOUBLE HEAT EXCHANGER

CROSS-REFERENCE TO RELATED APPLICATION

This application is related to and claims priority from Japanese Patent Applications No. Hei. 11-89792 filed on Mar. 30, 1999, and No. Hei. 11-242097 filed on Aug. 27, 1999, the contents of which are hereby incorporated by reference.

BACKGROUND OF THE INVENTION

1. Field of the Invention

The present invention relates to a double heat exchanger having plural heat-exchanging units. For example, the present invention is suitable for an integrated double heat exchanger in which a condenser for a refrigerant cycle and a radiator for cooling engine-cooling water of a vehicle are integrated.

2. Description of Related Art

In a conventional double heat exchanger described in JP-A-10-170184, radiator fins and condenser fins are integrated so that both radiator and condenser are integrated. Further, by adjusting louver states formed in the radiator fins and the condenser fins, heat-exchanging capacities of the radiator and the condenser are adjusted, respectively. The louvers are formed by cutting and standing a part of fin flat portions to disturb a flow of air passing through the fins. Here, the louver state means a louver standing angle, a louver cutting length, a louver width dimension and the number of louvers, for example.

However, in the conventional double heat exchanger, both heat-exchanging capacities of the radiator and the condenser are adjusted only by adjusting the louver states, while both core sizes of the radiator and condenser are set to be approximately equal. Therefore, in a vehicle where the heat-exchanging capacity necessary in the condenser is greatly smaller than the heat-exchanging capacity necessary in the radiator, it is difficult to adjust both the heat-exchanging capacities of the radiator and the condenser only using the louver states. That is, the size and performance of the condenser become larger than necessary conditions.

SUMMARY OF THE INVENTION

In view of the foregoing problems, it is an object of the present invention to provide a double heat exchanger in which heat-exchanging capacities of plural heat-exchanging units are adjusted while size and performance of a heat-exchanging unit are prevented from increasing more than necessary conditions.

According to the present invention, in a double heat exchanger including first and second heat-exchanging units, the first and second heat-exchanging units are disposed to be integrated through a side plate for reinforcing the first and second heat-exchanging units, and second tubes of the second heat-exchanging unit have a tube dimension in a tube longitudinal direction of the second tubes, smaller than that of first tubes of the first heat-exchanging unit. Therefore, it is possible to decrease heat-exchanging capacity of the second heat exchanger while size and weight of the second heat-exchanging unit are prevented from being increased more than necessary conditions. As a result, it prevents the size and weight of the double heat exchanger from being increased while heat-exchanging capacities of the first and second heat-exchanging units are adjusted.

Preferably, the second tubes have tube number smaller than that of the first tubes. Therefore, the size and the weight of the double heat exchanger further reduced while the heat-exchanging capacity of the second heat exchanger is prevented from being increased more than the necessary capacity. Further, the double heat exchanger includes a reinforcement plate disposed to extend from an end of the second core portion to the side plate, for supporting and fixing the second heat-exchanging unit. Therefore, the second heat-exchanging unit is tightly connected to the first heat-exchanging unit.

Preferably, the first heat-exchanging unit is disposed at a downstream air side from the second heat-exchanging unit linearly in an air-flowing direction, each of the first and second tubes is a flat-shaped tube having a major diameter dimension in the air-flowing direction and a minor diameter dimension in a direction perpendicular to both a tube longitudinal direction and the air-flowing direction, and each minor diameter dimension of the second tubes is smaller than each minor diameter dimension of the first tubes. Therefore, even when a temperature boundary layer generated at most upstream ends of the second tubes in the air-flowing direction is increased toward a downstream air side in the second core portion, it can prevent a distance (i.e., temperature boundary layer thickness) between the first tubes and the temperature boundary layer from being increased. As a result, the temperature boundary layer generated from the second heat-exchanging unit hardly deteriorates the heat-exchanging performance of the first heat-exchanging unit.

More preferably, both the first and second tubes have major diameter center lines corresponding to each other in the air-flowing direction. Therefore, air smoothly passes through the first and second heat-exchanging units in the air-flowing direction.

On the other hand, according to the present invention, each the first corrugated fin has a first fin height between adjacent first tubes, different from a second fin height of each second corrugated fin between adjacent second tubes. Further, the first tubes have a first pitch distance between adjacent first tubes at centers of the first tubes, the second tubes have a second pitch distance between adjacent second tubes at centers of the second tubes, the second pitch distance is equal to the first pitch distance, and a tube thickness of each first tube between adjacent first corrugated fins is different from a tube thickness of each the second tube between adjacent second corrugated fins. Therefore, at ends of the first core portion and the second core portion, where the side plate contacts, a difference between a core height of the first core portion and a core height of the second core portion is not greatly changed. Thus, the first and second core portions tightly contact the side plate without greatly increasing the kinds of the side plate.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the accompanying drawings.

Figure 1:
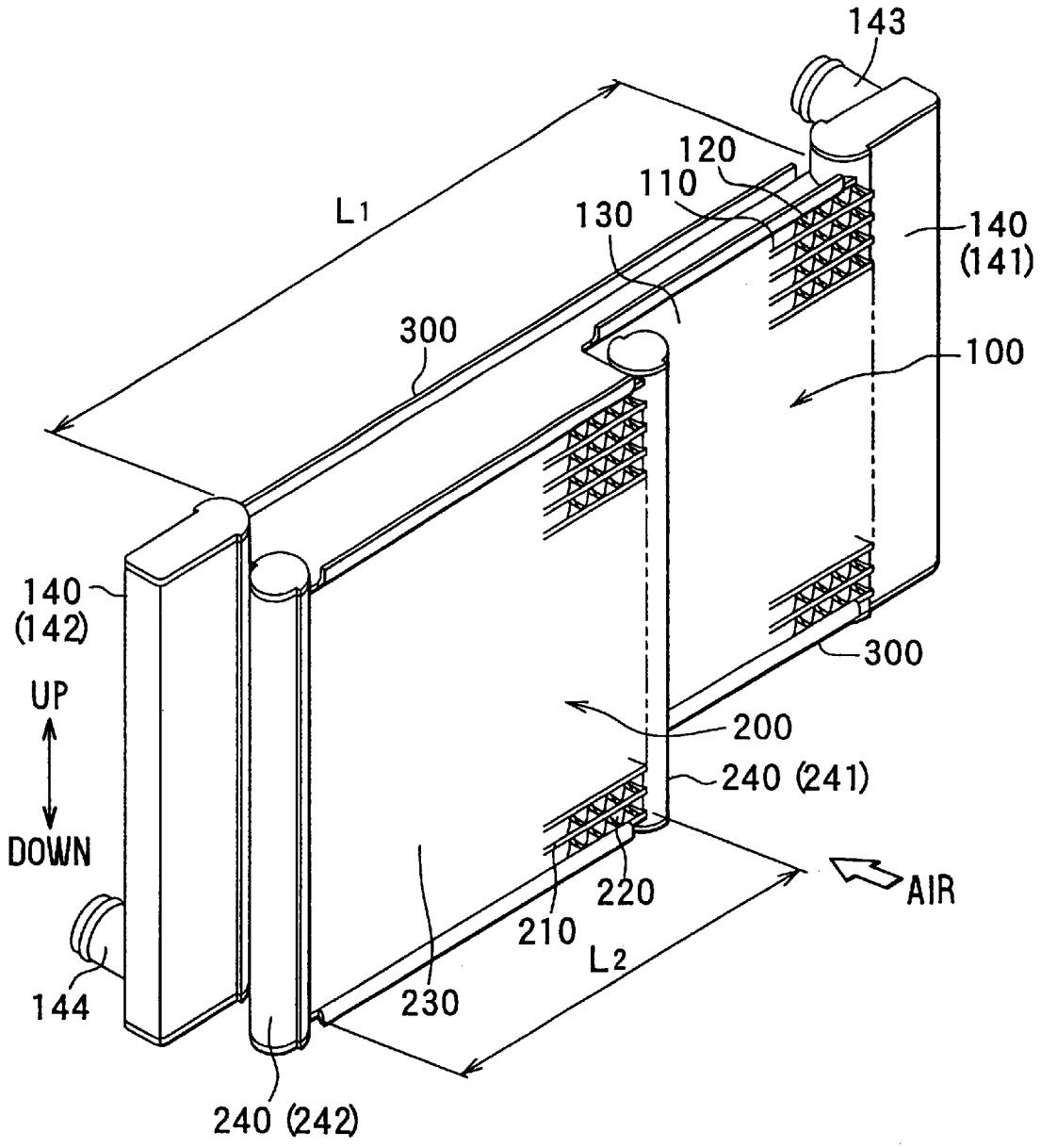
FIG. 1 is a perspective view of a double heat exchanger according to a first preferred embodiment of the present invention.

A first preferred embodiment of the present invention is described with reference to FIG. 1. In the first embodiment, the present invention is typically applied to a double heat exchanger where a radiator 100 for cooling engine-cooling water of a vehicle engine and a condenser 200 for cooling refrigerant of a refrigerant cycle are integrated, as shown in FIG. 1. FIG. 1 is a perspective view of the double heat exchanger according to the first embodiment. As shown in FIG. 1, the radiator 100 is disposed at a downstream air side of the condenser 200. Further, the radiator 100 and the condenser 200 are arranged linearly relative to an air-flowing direction.

The radiator 100 includes plural radiator tubes 110 extending in a tube longitudinal direction, and plural radiator corrugated fins (hereinafter, referred to as "radiator fins") 120 each of which is formed by roller-forming into a wave shape and is disposed between adjacent radiator tubes 110. Each of the radiator tubes 110 is formed into a flat like having a major-diameter dimension in the air-flowing direction. The radiator tubes 110 and the radiator fins 120 are integrally connected to form a radiator core portion 130. In the radiator core portion 130, engine-cooling water flowing through the radiator tubes 110 and air passing through between the radiator tunes 110 and the radiator fins 120 are heat-exchanged so that the engine-cooling water from the vehicle engine is cooled.

Further, the radiator 100 includes a radiator tank portion 140 disposed at both longitudinal ends of the radiator tubes 110 to extend in a tank longitudinal direction perpendicular to the tube longitudinal direction and to communicate with the plural radiator tubes 110. That is, the radiator tank portion 140 includes a first radiator header tank 141 for distributing and supplying cooling water from the vehicle engine into each of the radiator tubes 110, and a second radiator header tank 142 for collecting and recovering cooling water flowing from the radiator tubes 110. The first radiator header tank 141 is disposed at one side longitudinal ends of the radiator tubes 110, and the second radiator header tank 142 is disposed at the other side longitudinal ends of the radiator tubes 110.

A cooling-water outlet side of the vehicle engine is coupled to an inlet portion 143 so that engine-cooling water from the vehicle engine is introduced into the first radiator header tank 141 through the inlet portion 143. On the other hand, a cooling water inlet side of the vehicle engine is coupled to an outlet portion 144 so that the engine-cooling water having been heat-exchanged in the radiator core portion 130 is returned to the vehicle engine through the outlet portion 144.

On the other hand, the condenser 200 includes plural condenser tubes 210 extending in a tube longitudinal direction, and plural condenser corrugated fins (hereinafter, referred to as "condenser fins") 220 each of which is formed by roller-forming into a wave shape and is disposed between adjacent condenser tubes 210. Each of the condenser tubes 210 is formed into a flat like having a major-diameter dimension in the air-flowing direction. The condenser tubes 210 and the condenser fins 220 are integrally connected to form a condenser core portion 230. In the condenser core portion 230, refrigerant of the refrigerant cycle flowing through the condenser tubes 210 and air passing through between the condenser tubes 210 and the condenser fins 220 are heat-exchanged so that the refrigerant is cooled and condensed.

Further, the condenser 200 includes a condenser tank portion 240 disposed at both longitudinal ends of the condenser tubes 210 to extend in a tank longitudinal direction perpendicular to the tube longitudinal direction and to communicate with the plural condenser tubes 210. That is, the condenser tank portion 240 includes a first condenser header tank 241 for distributing and supplying refrigerant from the refrigerant cycle into each of the condenser tubes 210, and a second condenser header tank 242 for collecting and recovering refrigerant flowing from the condenser tubes 210. The first condenser header tank 241 is disposed at one side longitudinal ends of the condenser tubes 210, and the second condenser header tank 242 is disposed at the other side longitudinal ends of the condenser tubes 210.

In the first embodiment, each longitudinal dimension L2 of the condenser tubes 210 between the first and second condenser header tanks 241, 242 is set to be smaller than each longitudinal dimension L1 of the radiator tubes 110 between the first and second radiator header tanks 141, 142, so that a core area of the condenser core portion 230 is made smaller than a core area of the radiator core portion 130. Here, the core area of the condenser core portion 230 is a reflection area of the condenser core portion 230 on a surface perpendicular to the air-flowing direction. Similarly, the core area of the radiator core portion 130 is a reflection area of the radiator core portion 130 on a surface perpendicular to the air-flowing direction.

On both side ends of both the core portions 130, 230, side plates 300 for reinforcing both the core portions 130, 220 are provided. The side plates 300 are disposed to extend in a direction parallel to the flat tubes 110, 210. In the first embodiment, the radiator 100 and the condenser 200 are integrated through the side plates 300.

In the double heat exchanger, the tubes 110, 210, the fins 120, 220, the tank portions 140, 240 and the side plates 300 are made of aluminum, and are integrally bonded through brazing.

According to the first embodiment of the present invention, the longitudinal dimension L2 of the condenser tubes 210 is set to be smaller than the longitudinal dimension L1 of the radiator tubes L1, so that the core area of the condenser core portion 230 is made smaller than the core area of the radiator core portion 130. Therefore, in the double heat exchanger where the radiator 100 and the condenser 200 are integrated, the size and the weight of the condenser 200 become smaller. As a result, it prevents the size and the performance of the double heat exchanger from being increased too much as compared with necessary conditions, while heat-radiating capacity (i.e., heat-exchanging capacity) of the condenser 200 is adjusted.

Figure 2:
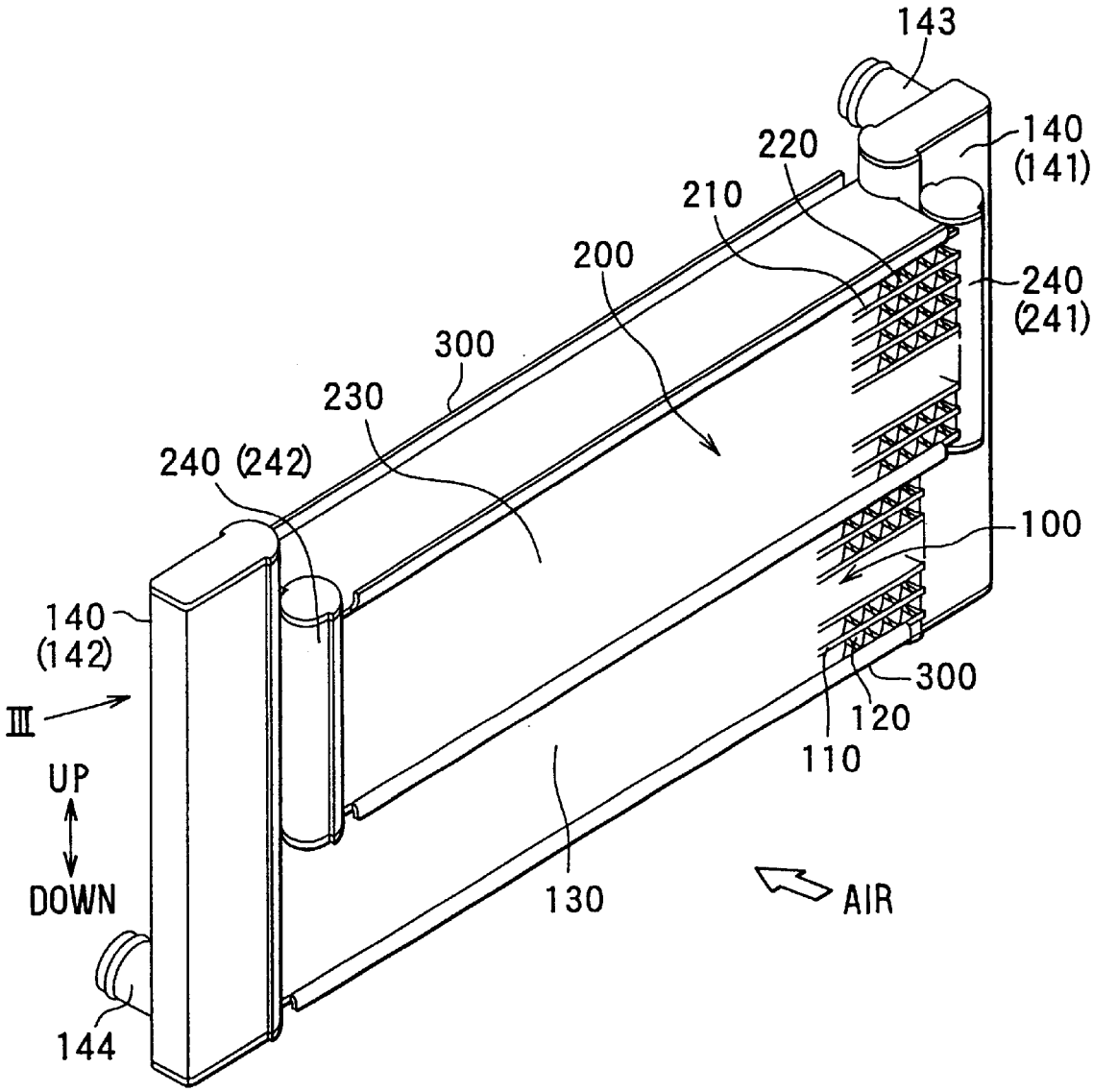
FIG. 2 is a perspective view of a double heat exchanger according to a second preferred embodiment of the present invention.
Figure 3:
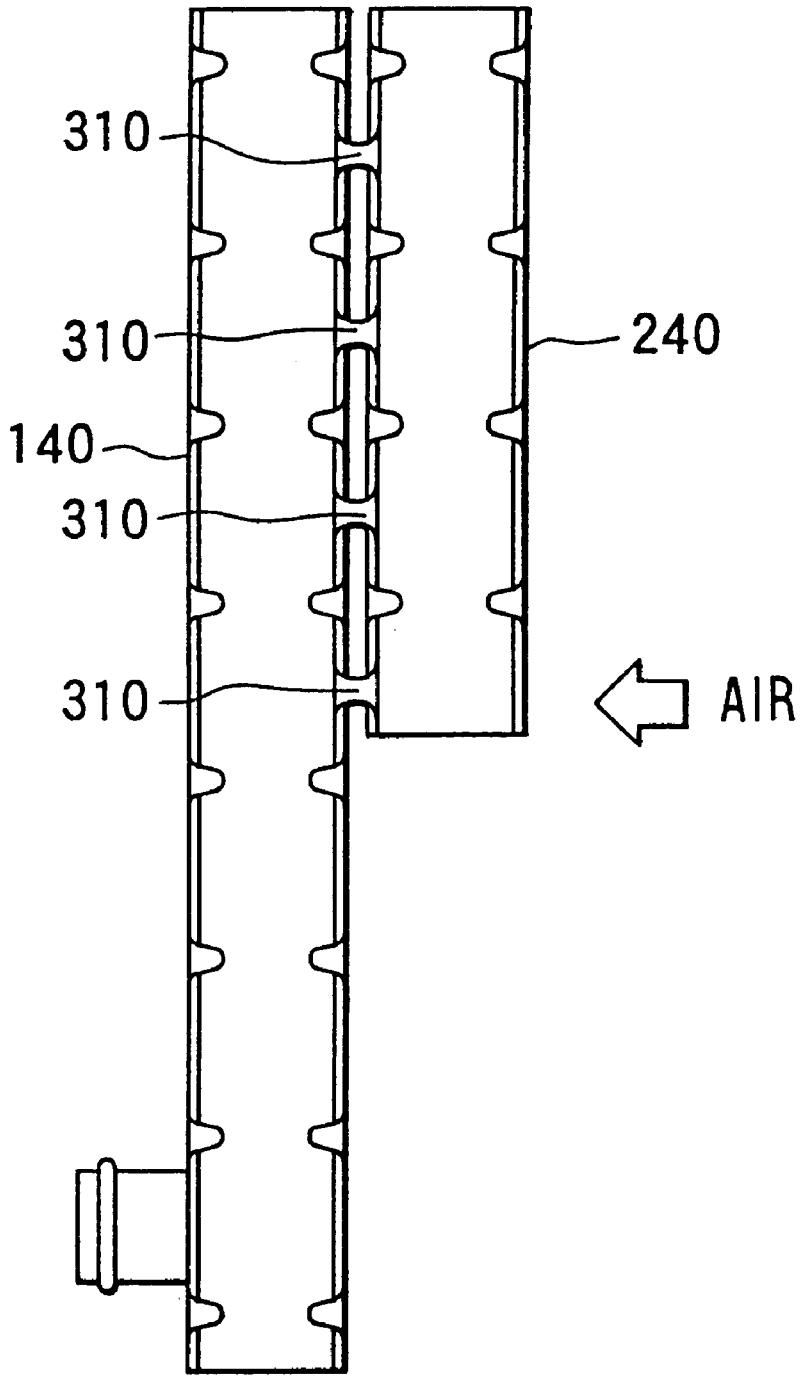
FIG. 3 is a schematic sectional view when being viewed from arrow III in FIG. 2.

A second preferred embodiment of the present invention will be now described with reference to FIGS. 2 and 3. In the above-described first embodiment of the present invention, the longitudinal dimension L2 of the condenser tubes 210 is set to be smaller than the longitudinal dimension L1 of the radiator tubes 110, so that the core area of the condenser core portion 230 is made smaller than the core area of the radiator core portion 130. However, in the second embodiment, as shown in FIG. 2, the number of the condenser tubes 210 is set to be smaller than that of the radiator tubes 110, so that the core area of the condenser core portion 230 is made smaller than the core area of the radiator core portion 130. In the second embodiment, the radiator 100 and the condenser 200 are integrated by one-side side plate 300. Further, as shown in FIG. 3, both the tank portions 140, 240 are integrally connected by connection portions 310 separately formed in the tank longitudinal direction of both the tank portions 140, 240 between both the tank portions 140, 240. In the second embodiment, the other portions are similar to those in the above-described first embodiment. Thus, in the second embodiment, the effect similar to that of the first embodiment is obtained.

Figure 4:
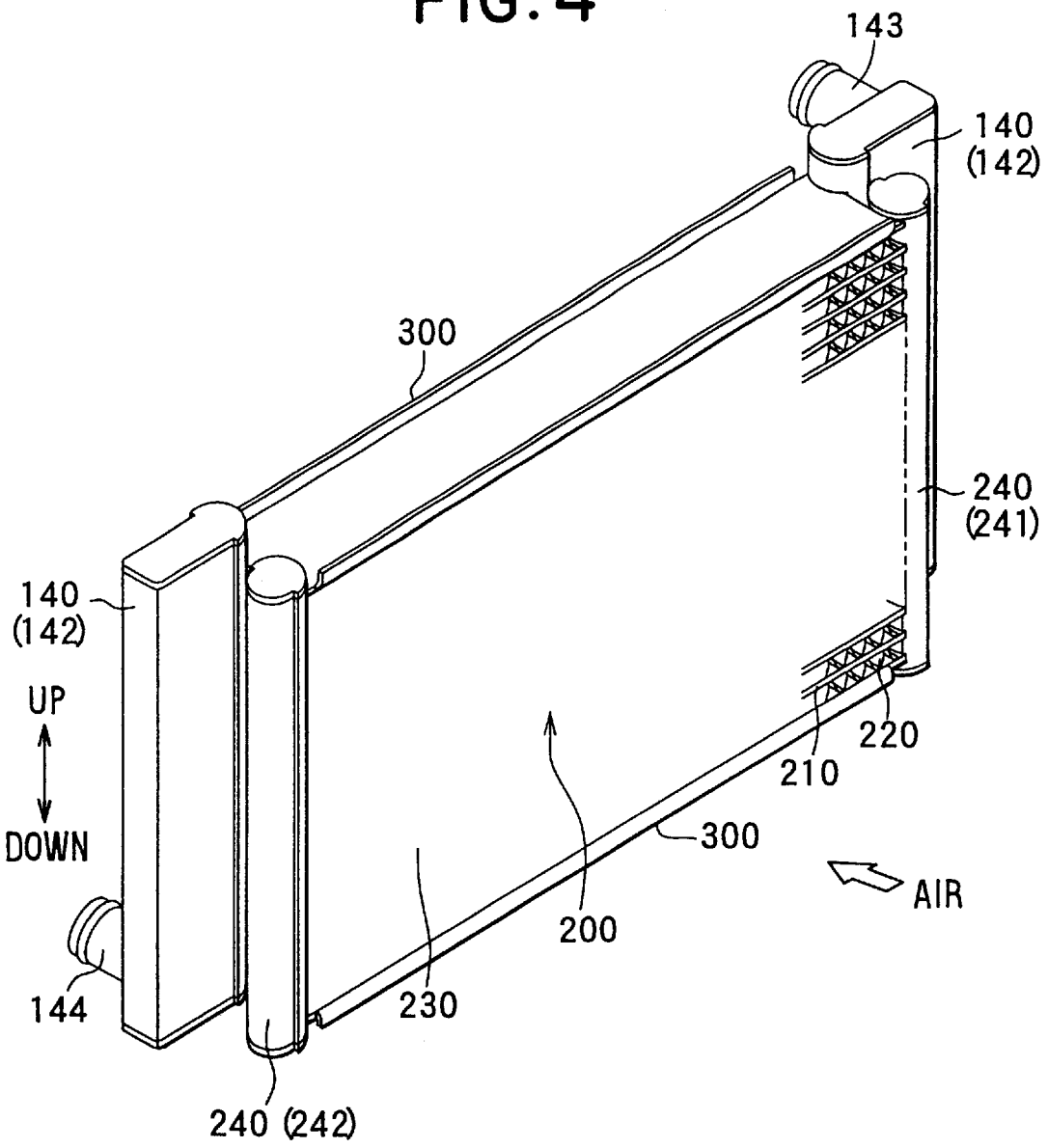
FIG. 4 is a perspective view of a double heat exchanger according to a third preferred embodiment of the present invention.
Figure 5:
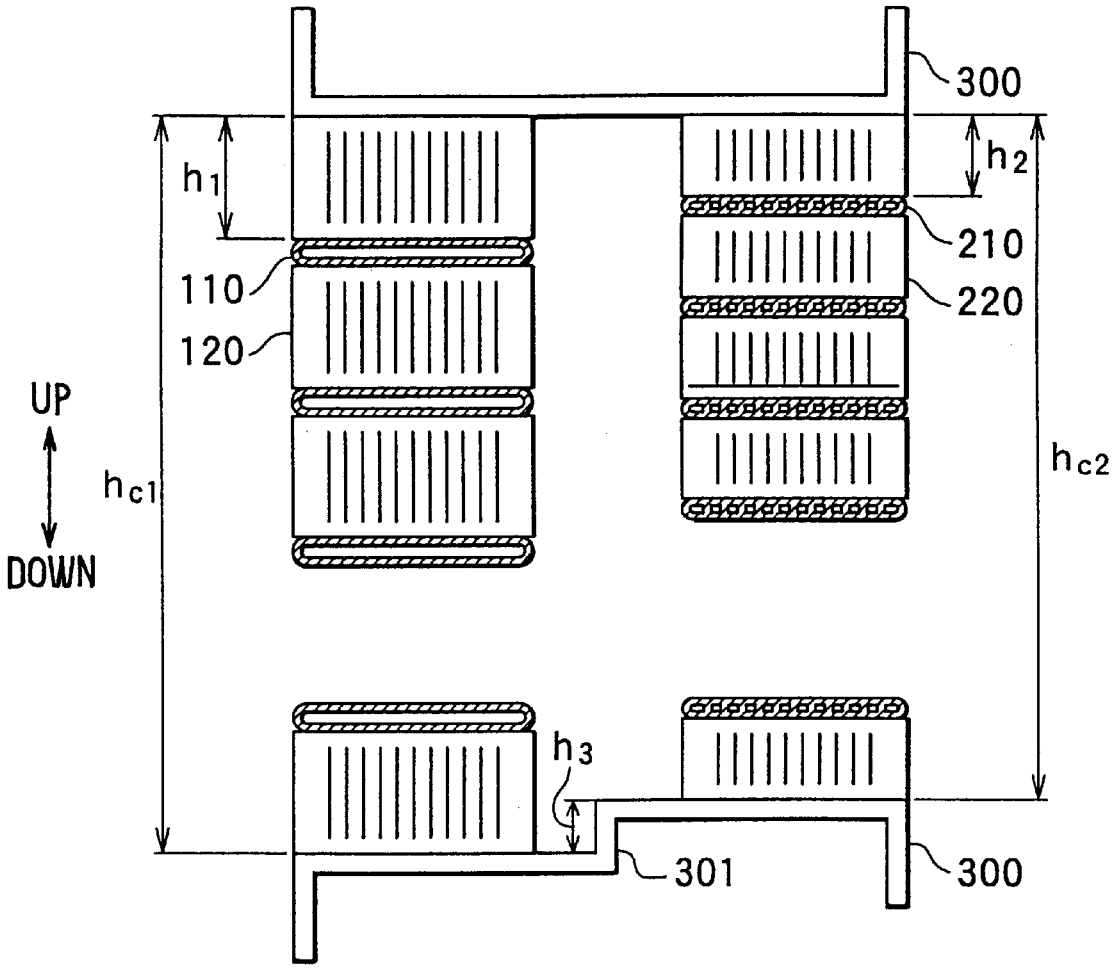
FIG. 5 is a partially sectional view of core portions of the double heat exchanger according to the third embodiment.

A third preferred embodiment of the present invention will be now described with reference to FIGS. 4 and 5. In the third embodiment, as shown in FIG. 4, the core area of the condenser core portion 230 is set to be approximately equal to that of the radiator core portion 130. However, as shown in FIG. 5, a fin height h2 of the condenser fins 220 is set to be smaller than a fin height h1 of the radiator fins 110, so that the heat-exchanging capacity of the condenser core portion 230 is made smaller than the heat-exchanging capacity of the radiator core portion 130. Here, the fin height h2 is a dimension between peaks and troughs of each the wave-shaped condenser fin 220, and the fin height h1 is a dimension between peaks and troughs of each the wave-shaped radiator fin 120. With a dimension difference between the fin heights h1, h2, a core height hc1 of the radiator core portion 130 is different from a core height hc2 of the condenser core portion 230. In the third embodiment, a step portion 301 having a height dimension h3 is provided in a lower-side side plate 300, so that the condenser core portion 230 and the radiator core portion 130 having different core heights hc1, hc2 are integrated through the side plate 300.

Figure 6:
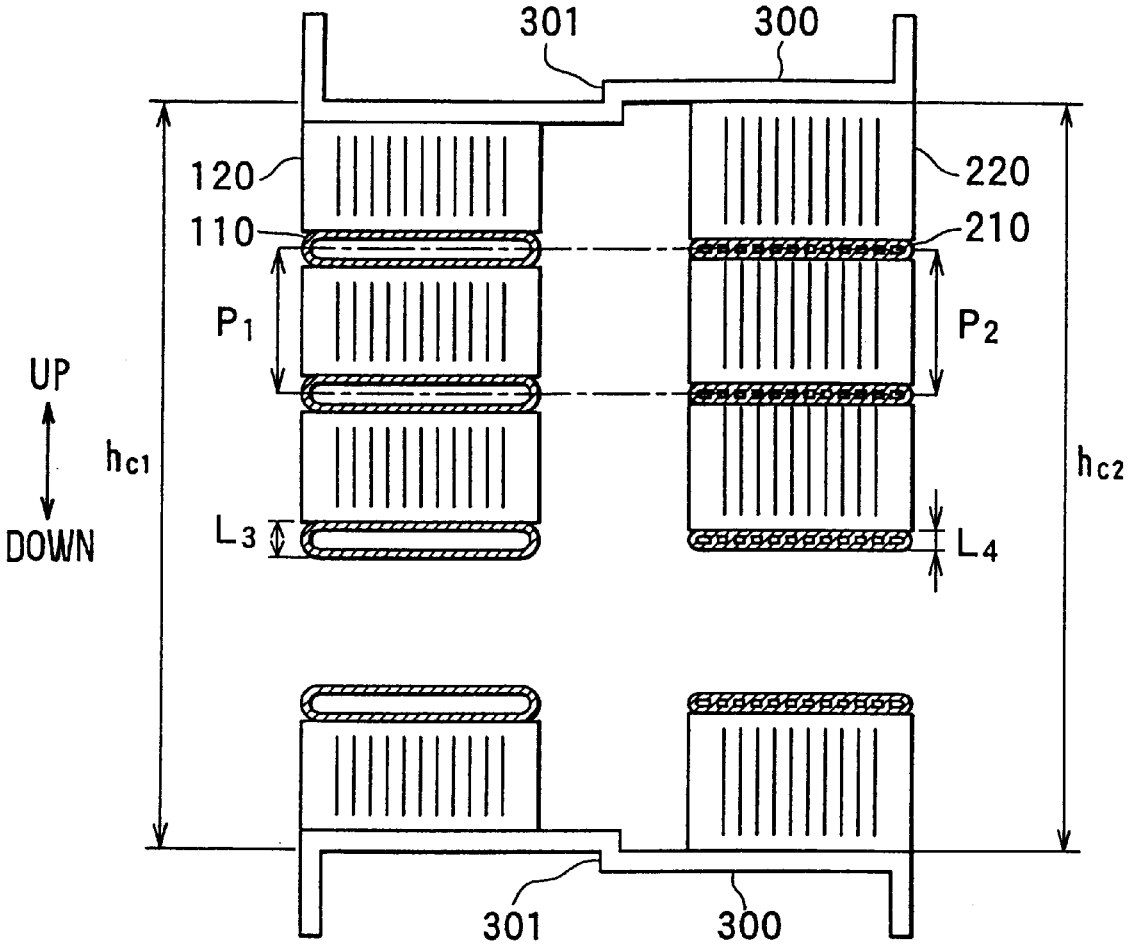
FIG. 6 is a partially sectional view of core portions of a double heat exchanger according to a fourth preferred embodiment of the present invention.

A fourth preferred embodiment of the present invention will be now described with reference to FIG. 6. As shown in FIG. 6, a distance between centers of the adjacent radiator tubes 110, i.e., a pitch P1 between adjacent radiator tubes 110, is set to be equal to a distance between centers of the adjacent condenser tubes 210, i.e., a pitch P2 between adjacent radiator tubes 110. However, in the fourth embodiment, each tube thickness L3 (i.e., minor-diameter dimension) of the radiator tubes 110 is made smaller than each tube thickness L4 (i.e., minor-diameter dimension) of the condenser tubes 210. Here, the tube thickness L3 of the radiator tubes 110 is a dimension of each radiator tube 110, parallel to the tank longitudinal direction of the radiator tank portion 140. Similarly, the tube thickness L4 of the condenser tubes 210 is a dimension of each condenser tube 210, parallel to the tank longitudinal direction of the condenser tank portion 240.

That is, in the fourth embodiment of the present invention, the tube thickness L4 of the condenser tubes 210 is made smaller so that a flow rate of refrigerant in the condenser tubes 210 is increased and the fin height h2 of the condenser fins 220 is made larger. Therefore, it is compared with the heat-exchanging capacity of the condenser 200 described in the first and second embodiments, the heat-exchanging capacity of the condenser 200 is increased.

According to the fourth embodiment of the present invention, while the radiator tube pitch P1 is set to be equal to the condenser tube pitch P2, the tube thickness L3 (i.e., minor-diameter dimension) of the radiator tubes 110 and the fin height h1 of the radiator fins 120 are set to be different from the tube thickness L4 (i.e., minor-diameter dimension) of the condenser tubes 210 and the fin height h2 of the condenser fins 220, respectively. Therefore, the core height hc1 of the radiator core portion 130 is approximately equal to the core height hc2 of the condenser core portion 230. That is, the height dimension of the step portion 301 is a difference between the fin heights h1 and h2 of the fins 120, 220, and is not greatly changed. Thus, the core portions 130, 230 readily contact the side plates 300 having the slightly changed step portions 301, and a contacting state between the core portions 130, 230 and the side plates 300 is readily obtained by using small kinds of side plates 300.

A fifth preferred embodiment of the present invention will be now described with reference to FIGS. 7 and 8. In the fifth embodiment, a mechanical strength of the condenser 200 of the double heat exchanger described in the second embodiment is improved.

Figure 7:
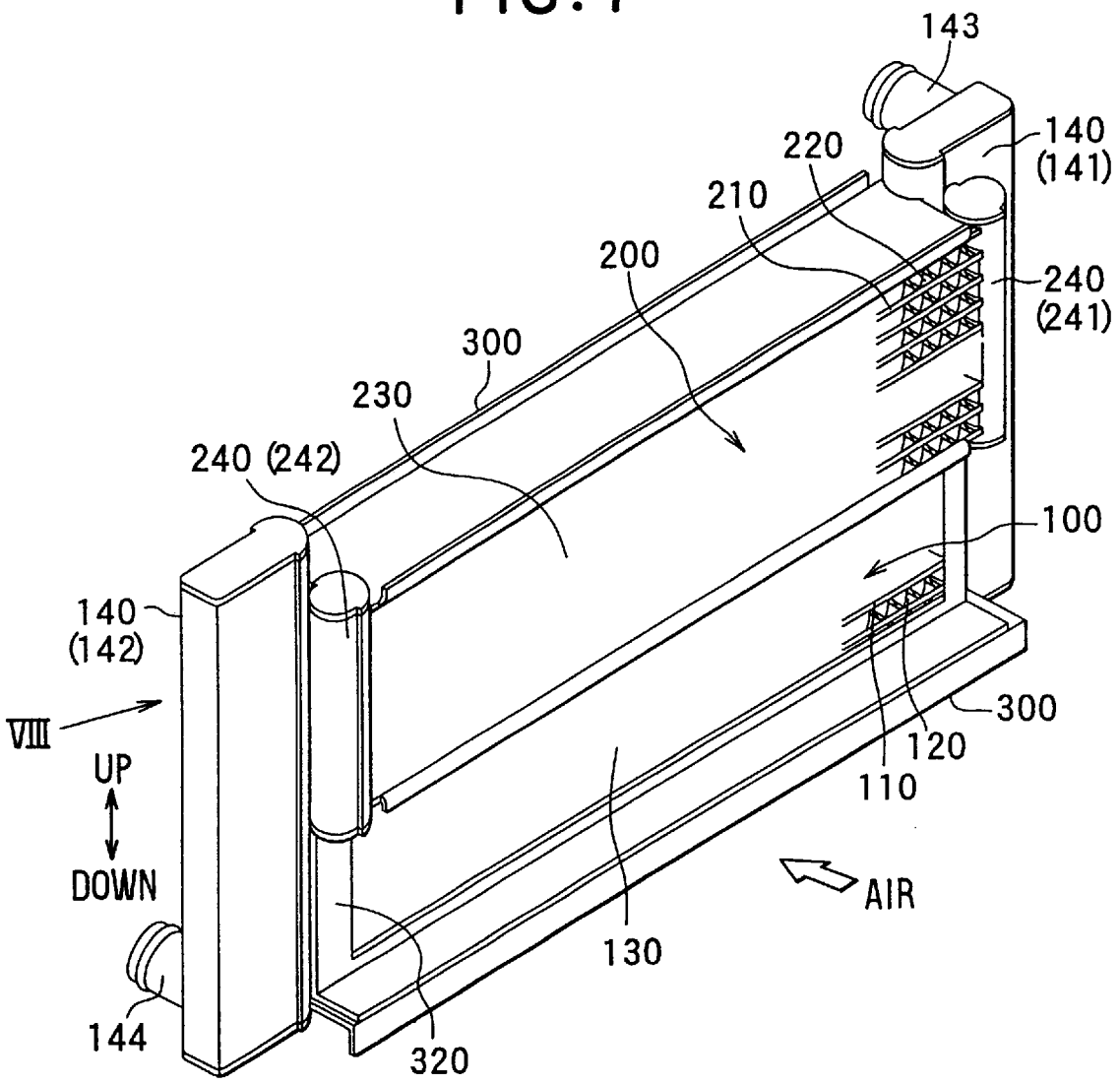
FIG. 7 is a perspective view of a double heat exchanger according to a fifth preferred embodiment.
Figure 8:
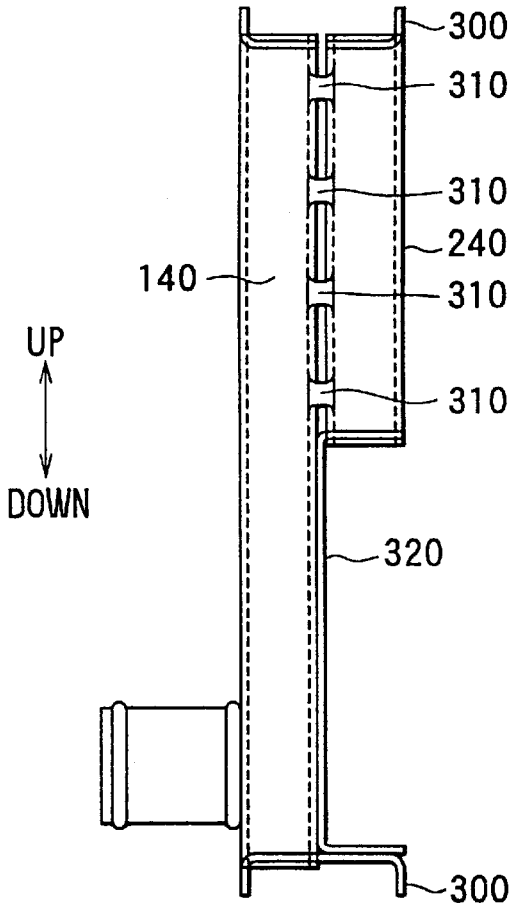
FIG. 8 is a schematic sectional view when being viewed from arrow VIII in FIG. 7.

FIG. 7 is a perspective view of a double heat exchanger according to the fifth embodiment. As shown in FIG. 7, the top side ends of both core portions 130, 230 are integrally connected through the side plate 300 having U-shaped cross section, similarly to the second embodiment. However, as shown in FIGS. 7, 8, the bottom side end of the condenser core portion 230 is supported and fixed by a reinforcement plate 320 extending from the bottom side end of the condenser core portion 230 to the bottom side end of the radiator core portion 130. Thus, the condenser core portion 230 is fastened and fixed to the radiator core portion 130 through the reinforcement plate 320 in addition to the connection portions 310 and the top-side side plate 300. AS a result, connection strength between both the core portions 130, 230 and the mechanical strength of the condenser core portion 230 (i.e., condenser 200) are improved.

Figure 10:
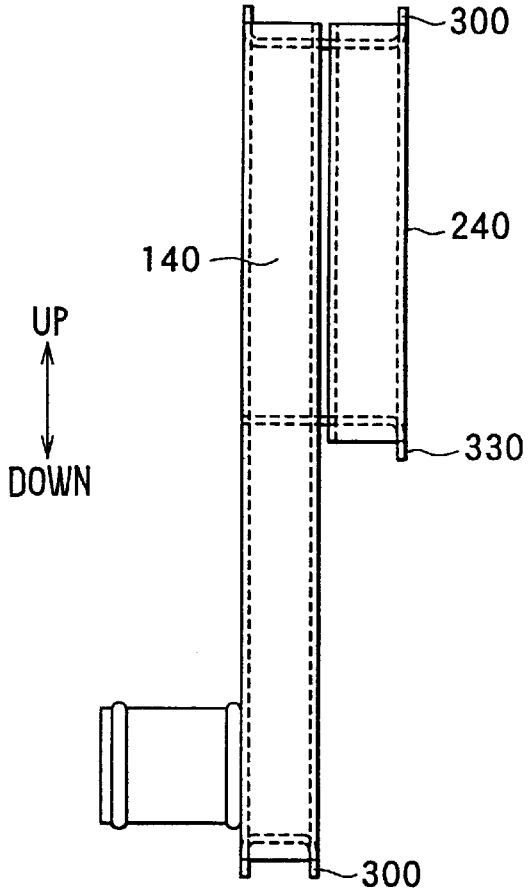
FIG. 10 is a schematic sectional view of a double heat exchanger according to the sixth embodiment.
Figure 9:
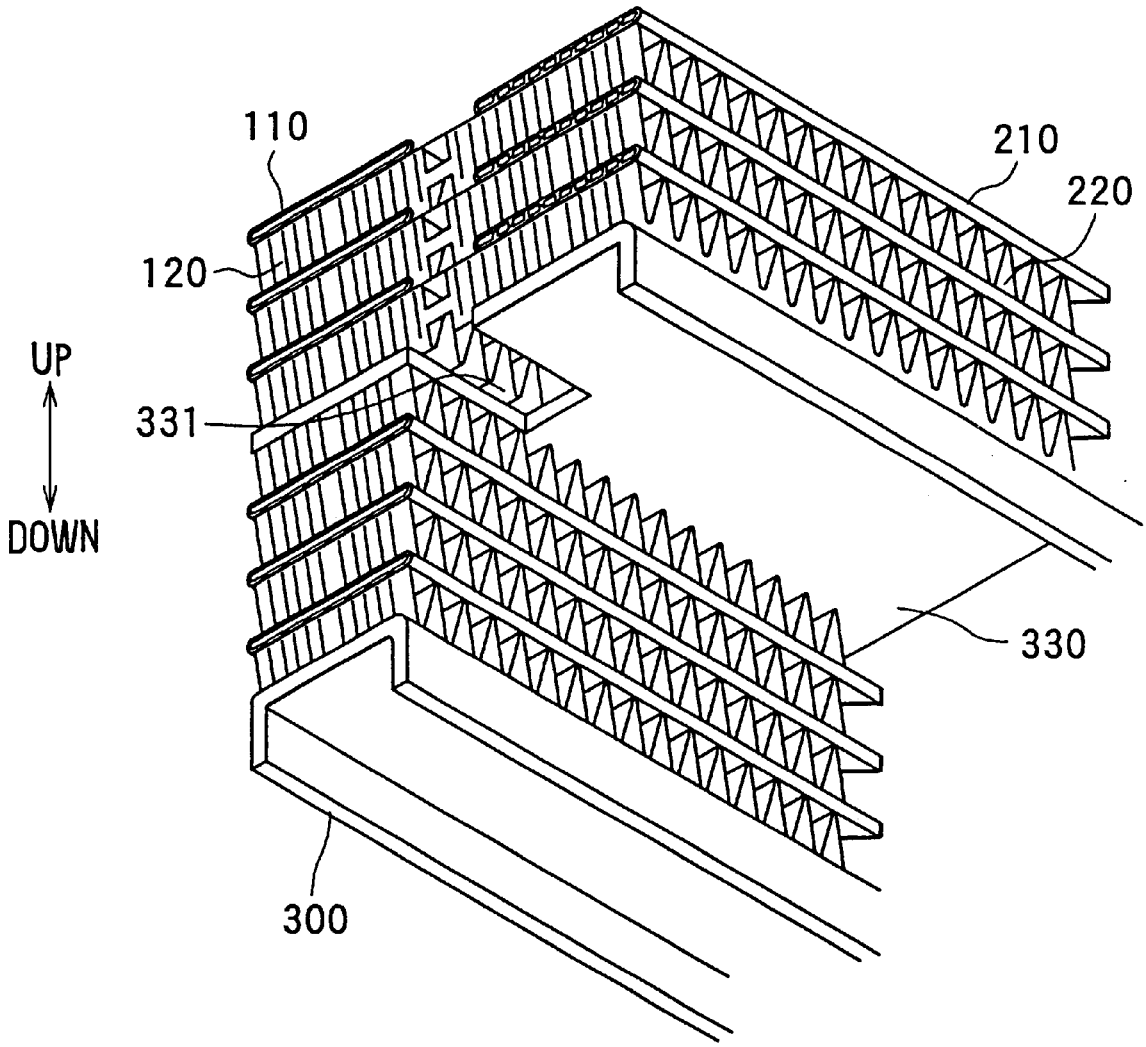
FIG. 9 is a perspective view of core portions of a double heat exchanger according to a sixth preferred embodiment of the present invention.

A sixth preferred embodiment of the present invention will be now described with reference to FIGS. 9 and 10. In the sixth embodiment, similarly to the fifth embodiment, the strength of the condenser 200 and the connection strength between both the core portions 130, 230 are improved in the double heat exchanger described in the second embodiment. As shown in FIGS. 9 and 10, a condenser side plate 330 for reinforcing the condenser core portion 230 is provided at the bottom side end of the condenser core portion 230 to extend in a direction parallel to the condenser tubes 210. The condenser side plate 330 extends to radiator core portion 130 to be connected to the radiator fins 120 and the radiator tank portion 140. The top side ends of both the core portions 130, 230 and the bottom side end of the radiator core portion 130 are formed similarly to those in the above-described second embodiment.

Further, in the sixth embodiment of the present invention, a recess portion 331 for reducing a heat-transmitting area is provided in the condenser side plate 331 to restrict heat from being transmitted from the radiator 100 to the condenser 200. Therefore, the recess portion 331 provided in the condenser side plate 331 prevents heat-exchanging capacity of the condenser 200 from being greatly reduced.

A seventh preferred embodiment of the present invention will be now described with reference to FIGS. 11. In the seventh embodiment, similarly to the fifth embodiment, the strength of the condenser 200 and the connection strength between the core portions 130, 230 are improved in the double heat exchanger described in the second embodiment.

Figure 11:
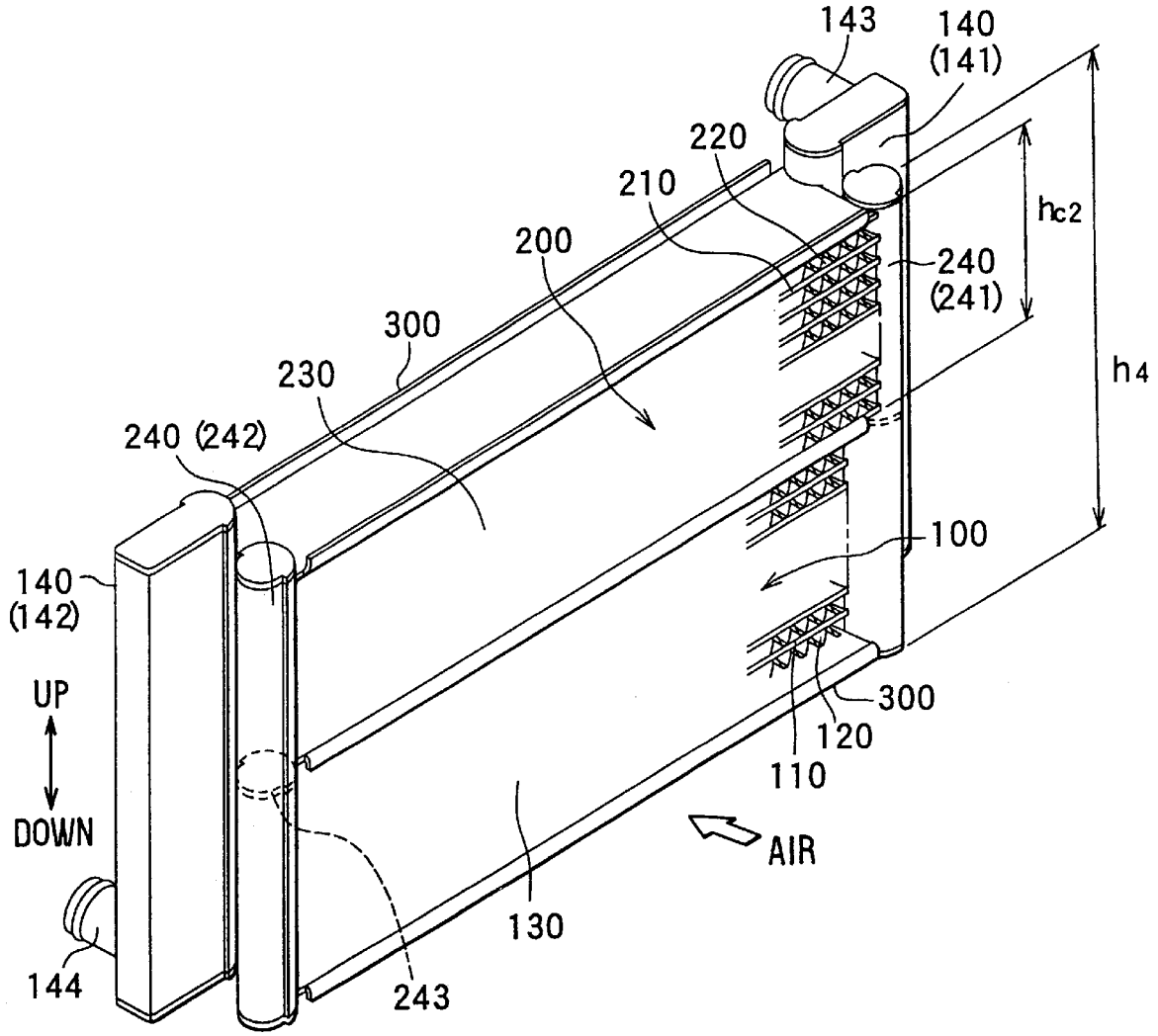
FIG. 11 is a perspective view of a double heat exchanger according to a seventh preferred embodiment of the present invention.

As shown in FIG. 11, in the seventh embodiment, the longitudinal dimension h4 of the condenser tank portion 240 is set to be larger than the core height hc2 of the condenser core portion 230. Further, both longitudinal ends of the condenser tank portion 240 are bonded and brazed to the side plates 300 connected to top and bottom side ends of the radiator core portion 130. Here, the core height hc2 is a dimension of the condenser core portion 230, parallel to the tank longitudinal direction of the condenser tank portion 240. In the seventh embodiment, the core height hc2 is a dimension between a condenser fin 220 at the top side end of the condenser core portion 230 and a condenser fin 220 at the bottom side end of the condenser core portion 230.

Because a lower side space of the condenser tank portion 240, lower than the condenser core portion 230 is an unnecessary space, a separator 243 is disposed within the condenser tank portion 240 to partition the unnecessary space and a necessary space in the condenser tank portion 240.

According to the seventh embodiment of the present invention, because both longitudinal ends of the condenser tank portion 240 are connected to the top and bottom-side side plates 300 connected to the radiator 100, the condenser 200 is tightly connected to the radiator 100, and the mechanical strength of the condenser 200 is improved.

Further, because the longitudinal dimension h4 of the condenser tank portion 240 is larger than the core height hc2, a connection part between the condenser tank portion 240 and the radiator tank portion 140, that is, the number of the connection portion 310 is increased. Thus, both the tank portions 140, 240 can be tightly connected, and the connection strength between the radiator 100 and the condenser 200 is improved.

Further, in the seventh embodiment, because both the tank portions 140, 240 are connected, both the tank portions 140, 240 can be integrally molded by extrusion or drawing.

Figure 12A:
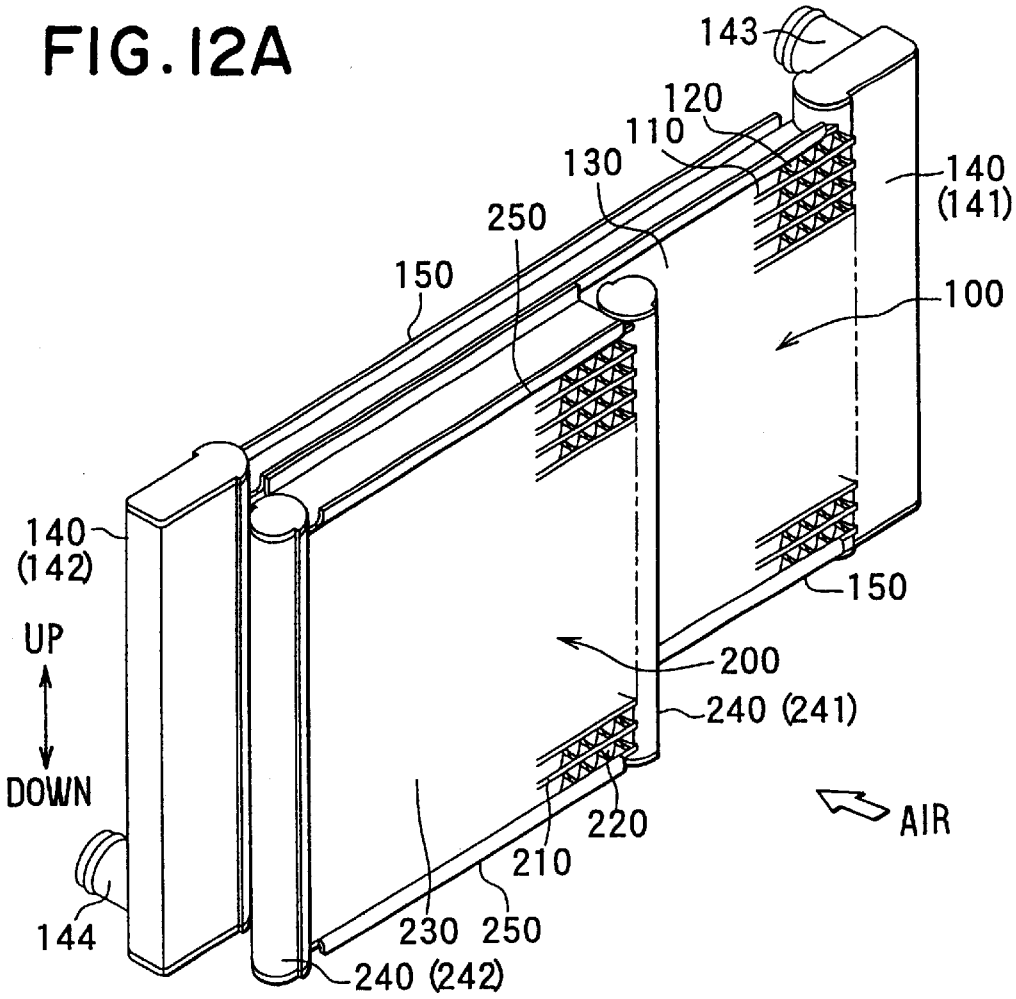
FIG. 12A is a perspective view of a double heat exchanger according to an eighth preferred embodiment of the present invention.
Figure 12B:
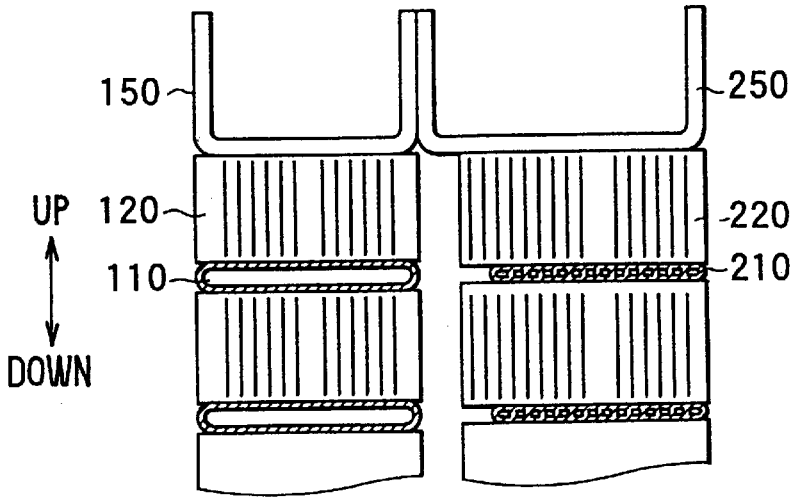
FIG. 12B is a partially sectional view of the double heat exchanger according to the eighth embodiment.

An eighth preferred embodiment of the present invention will be now described with reference to FIGS. 12A and 12B. In the eighth embodiment, as shown in FIG. 12A, 12B, the core portions 130, 230 and the tank portions 140, 240 are similar to those described in the above-described first embodiment. However, in the eighth embodiment, radiator side plates 150 for reinforcing the radiator core portion 130 and condenser side plates 250 for reinforcing the condenser core portion 230 are respectively independently formed. By bonding both the radiator side plate 150 and the condenser side plate 250 through brazing, the radiator 100 and the condenser 200 having different core areas are integrated. The brazing of the radiator side plate 150 and the condenser side plate 250 are performed at the brazing step where both the core portions 130, 230 and both the tank portions 140, 240 are brazed.

Figure 13:
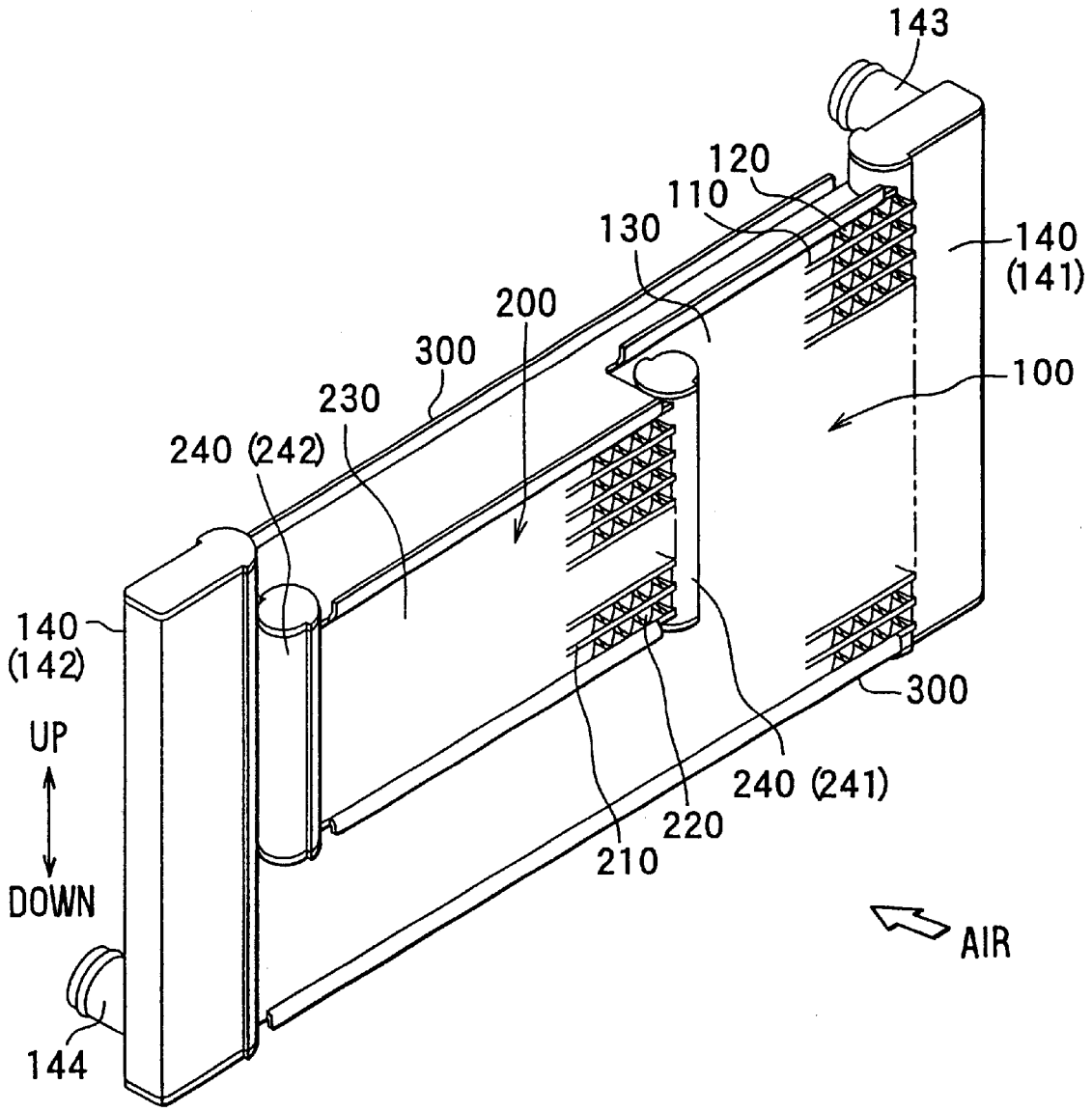
FIG. 13 is a perspective view of a double heat exchanger according to a ninth preferred embodiment of the present invention.

A ninth preferred embodiment of the present invention will be now described with reference to FIG. 13. As shown in FIG. 13, the number of the condenser tubes 210 is decreased in the double heat exchanger described in the first embodiment. Therefore, in the ninth embodiment, the heat-exchanging capacity of the condenser 200 is further reduced as compared with the above-described first embodiment.

Figure 14:
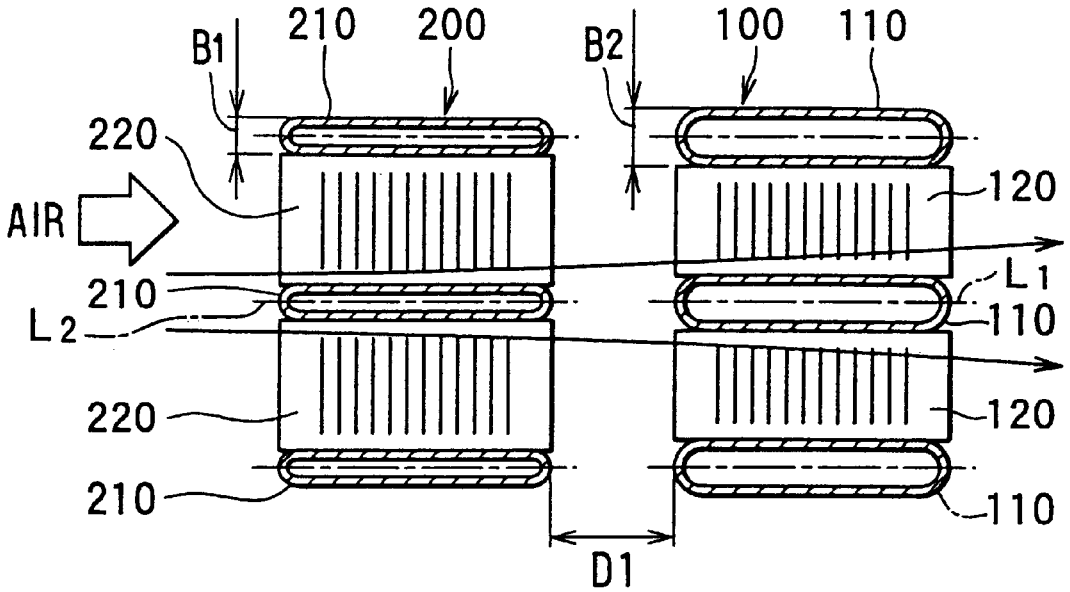
FIG. 14 is a partially sectional view of core portions of a double heat exchanger according to a tenth preferred embodiment of the present invention.
Figure 15:
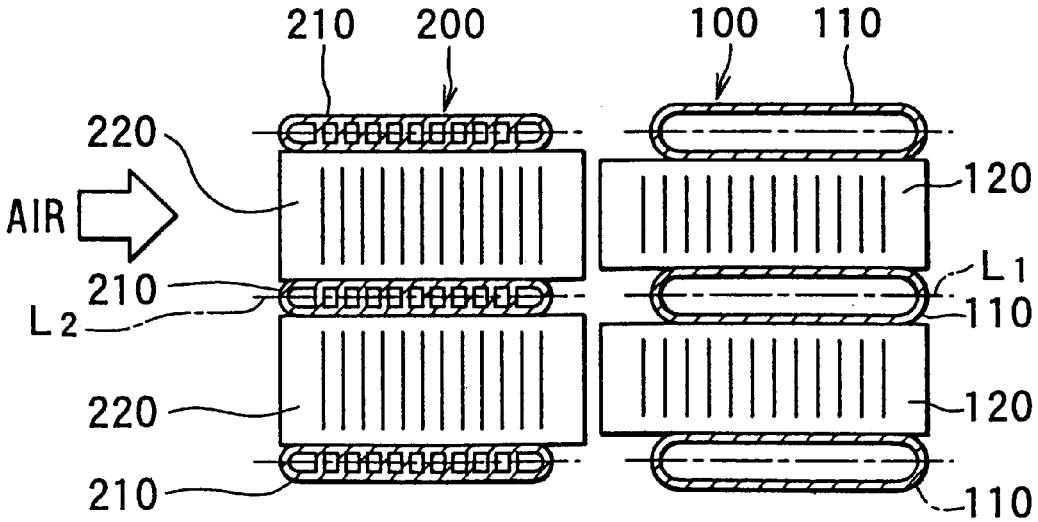
FIG. 15 is a partially sectional view showing a structure of the core portions where radiator fins protrude toward a condenser, according to the tenth embodiment.

A tenth preferred embodiment of the present invention will be now described with reference to FIGS. 14 and 15. In the tenth embodiment, as shown in FIGS. 14, 15, a minor-diameter dimension B1 of each the condenser tube 210 is made smaller than a minor-diameter dimension B2 of each the radiator tube 110, while center lines L1 and L2 of both radiator and condenser tubes 110, 210 in a major-diameter direction of the flat tubes 110, 210 are corresponded to each other when being viewed from the air-flowing direction.

In the tenth embodiment, the radiator tubes 110 and the condenser tubes 210 are disposed to have therebetween a distance D1 equal to 20 mm or smaller than 20 mm, while heat transmitted from the radiator 100 to the condenser 200 is restricted. Further, a difference between the minor dimension B1 of each condenser tubes 210 and the minor dimension B2 of the radiator tubes 110 is set to be equal to or smaller than 1 mm. Thus, even when a temperature boundary layer generated at most upstream ends of the condenser tubes 210 in the air-flowing direction is increased toward a downstream air side in the condenser core portion 230, it can prevent a distance (i.e., temperature boundary layer thickness) between the radiator tube 110 and the temperature boundary layer from being increased. As a result, the temperature boundary layer generated from the condenser 200 hardly deteriorates the heat-exchanging performance of the radiator 100.

Further, because the minor-diameter dimension B1 of each the condenser tube 210 on an upstream air side is smaller than the minor-diameter dimension B2 of each the radiator tube 110 on a downstream air side, an air flow resistance in the core portions 230, 130 becomes smaller. Further, because the center lines L1 and L2 of both radiator and condenser tubes 110, 210 in the major-diameter direction of the flat tubes 110, 210 are corresponded to each other when being viewed from the air-flowing direction, air smoothly flows through the core portions 130, 230, and the air flow resistance is further reduced.

The minor-diameter dimensions B1, B2 of both the radiator and condenser tubes 110, 210 may be changed in the above-described first through ninth embodiment, similarly to the tenth embodiment.

Figure 16:
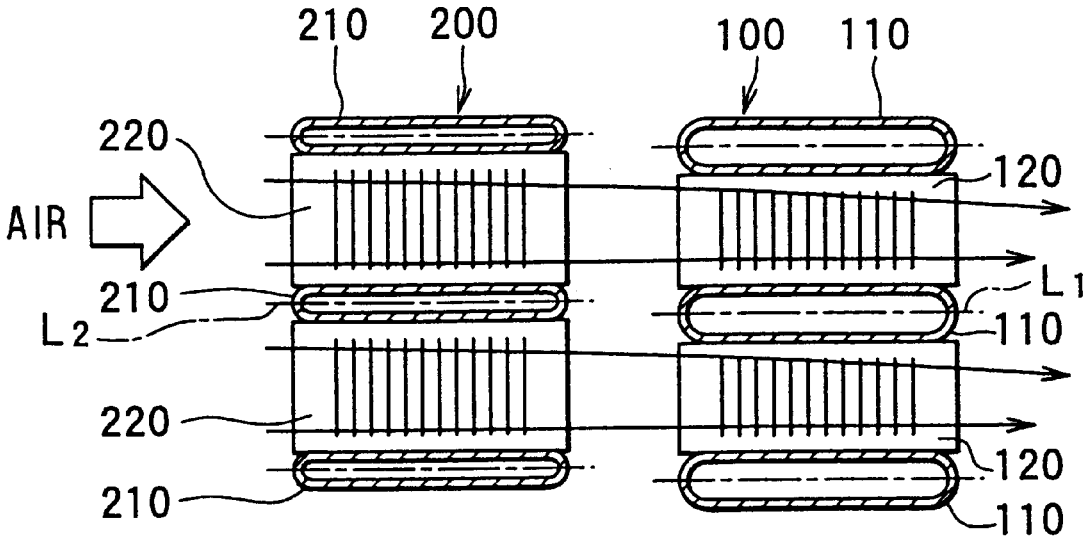
FIG. 16 is a partially sectional view of core portions of a double heat exchanger according to an eleventh preferred embodiment of the present invention.

An eleventh preferred embodiment of the present invention will be now described with reference to FIG. 16. In the above-described tenth embodiment, the center lines L1 and L2 of both radiator and condenser tubes 110, 210 in the major-diameter direction of the flat tubes 110, 210 are corresponded to each other when being viewed from the air-flowing direction. However, in the eleventh embodiment, as shown in FIG. 16, the center lines L1 and L2 of both radiator and condenser tubes 110, 210 in the major-diameter direction of the flat tubes 110, 210 are offset from each other when being viewed from the air-flowing direction.

Although the present invention has been fully described in connection with the preferred embodiments thereof with reference to the accompanying drawings, it is to be noted that various changes and modifications will become apparent to those skilled in the art.

Figure 17:
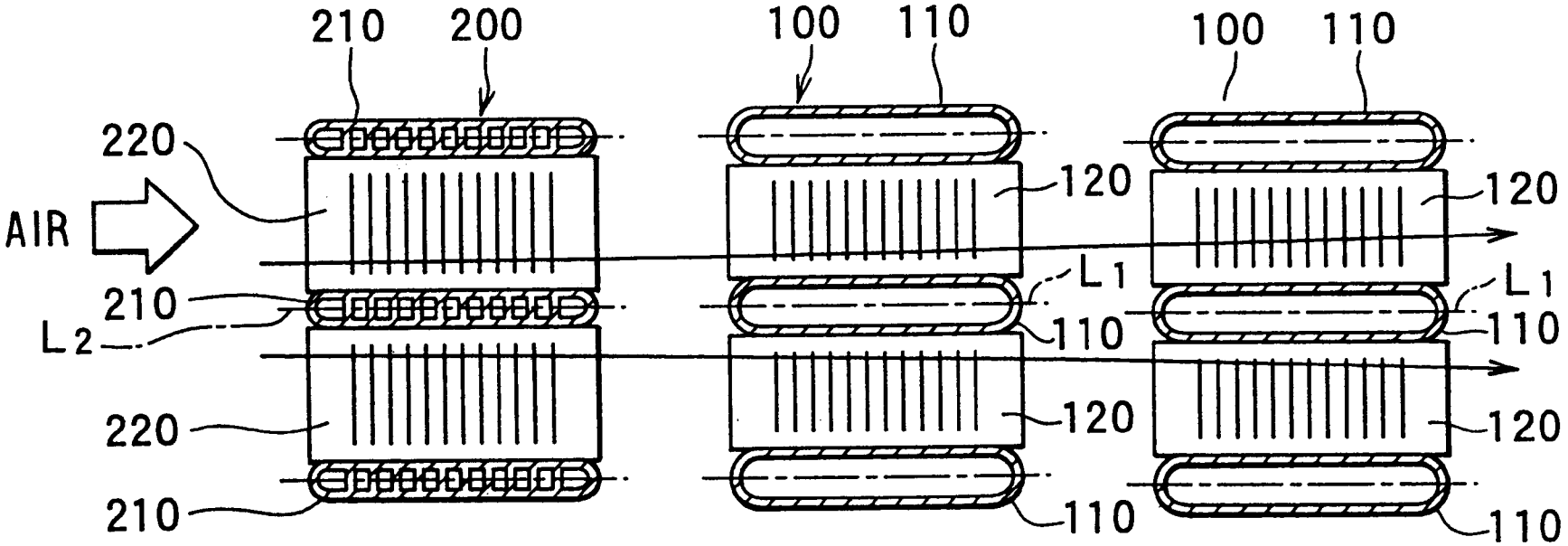
FIG. 17 is a partially sectional view of core portions of a double heat exchanger having plural heat-exchanging units more than three, according to a modification of the present invention.

For example, in the above-described embodiments, the present invention is typically applied to a double heat exchanger where the radiator 100 and the condenser 200 are integrated. However, the present invention may be applied to a double heat exchanger where plural heat-exchanging units are integrated. For example, the double heat exchanger may be constructed by three or more heat-exchanging units, as shown in FIG. 17.

Figure 18:
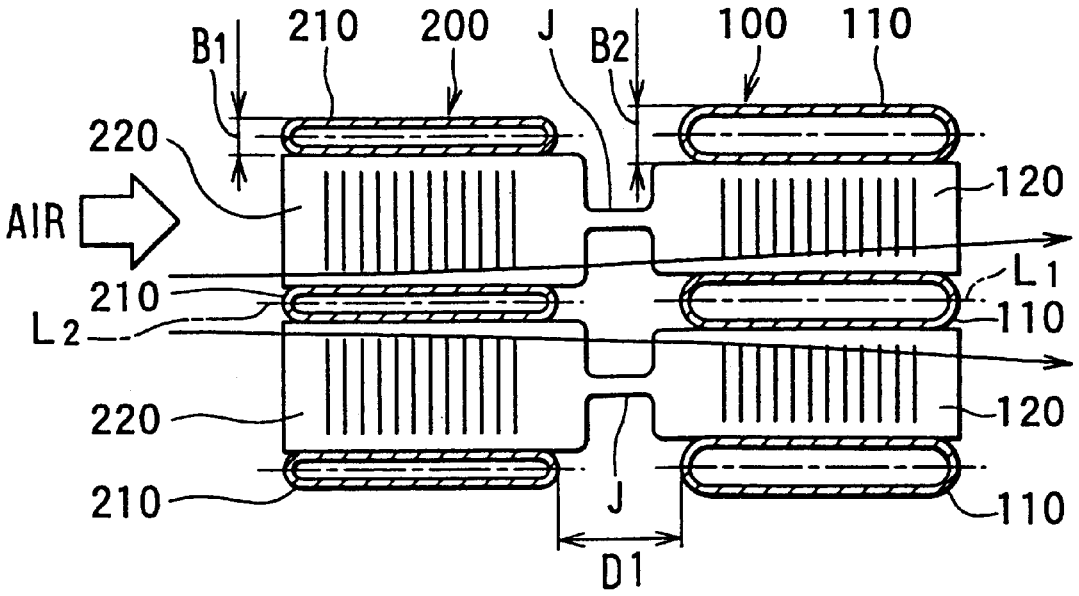
FIG. 18 is a sectional view of core portions of a double heat exchanger according to an another modification of the present invention.

In the above-described embodiments, the radiator fins 120 and the condenser fins 220 may be integrated, as shown in FIG. 9. Specifically, as shown in FIG. 18, fin connection portions J for partially connecting the corrugated fins 120, 220 may be provided.

Such changes and modifications are to be understood as being within the scope of the present invention as defined by the appended claims.

What is claimed is:

1. The heat exchanger comprising:

a first heat-exchanging unit for performing heat exchange between a first fluid and air, said first heat exchanging unit includes a plurality of first tubes through which said first fluid flows, a plurality of first corrugated fins disposed between adjacent first tubes, and a first tank portion disposed to communicate with said first tubes, at both longitudinal ends of each aid first tube;

a second heat-exchanging unit for performing heat exchange between a second fluid and air, said second heating-exchanging unit includes a plurality of second tubes through which said second fluid flows, said second tubes extending in parallel with said first tubes, a plurality of second corrugated fins disposed between adjacent said second tubes, and a second tank portion disposed to communicate with said second tubes, at both longitudinal ends of each said second tube;

a side plate disposed in parallel with said first and second tubes, for reinforcing said first and second heat-exchanging units, wherein:

said first and second heat-exchanging units are disposed to be integrated through said side plate;

said second tubes have a tube dimension in a tube longitudinal direction of said second tubes, smaller than that of said first tubes, in such a manner that the first heat-exchanging unit has an overlapping portion overlapping with said second heat-exchanging unit in an air-flowing direction and a non-overlapping portion in the air-flowing direction;

in the overlapping portion, air passes through both said first heat-exchanging unit and said second heat-exchanging unit; and in the non-overlapping portion, air only passes through the first heat-exchanging unit.

2. The heat exchanger according to claim 1, wherein said second tubes have tube number smaller than that of said first tubes, while said first and second tubes have the same pitch.

3. A heat exchanger comprising:

a first heat-exchanging unit for performing heat exchange between a first fluid and air, said first heat-exchanging unit includes a plurality of first tubes through which said first fluid flows, plurality of first corrugated fins disposed between adjacent first tubes, and a first tank portion disposed to communicate with said first tubes, at both longitudinal ends of each aid first tube;

a second heat-exchanging unit for performing heat exchange between a second fluid and air, said second heating-exchanging unit includes a plurality of second tubes through which said second fluid flows, said second tubes extending in parallel with said first tubes, a plurality of second corrugated fins disposed between adjacent said second tubes, and a second tank portion disposed to communicate with said second tubes, at both longitudinal ends of each said second tube;

a side plate disposed in parallel with said first and second tubes, for reinforcing said first and second heat-exchanging units wherein;

said first and second heat-exchanging units are disposed to be integrated through said side plate;

said second tubes have a tube dimension in a tube longitudinal direction of said second tubes, smaller than that of said first tubes;

said side plate includes a first side plate portion for reinforcing said first heat-exchanging unit, and a second side plate portion for reinforcing said second heat-exchanging unit; and said first and second heat-exchanging units are integrated by bonding said first and second side plate portions through brazing.

4. The heat exchanger according to claim 1, further comprising a fin connection portion through which both said first and second fins are partially connected.

5. The heat exchanger according to claim 1, wherein:

said first heat-exchanging unit is disposed at a downstream air side from said second heat-exchanging unit linearly in an air-flowing direction;

each of said first and second tubes is a flat-shaped tube having a major diameter dimension in the air-flowing direction and a minor diameter dimension in a direction perpendicular to both the tube longitudinal direction and the air-flowing direction; and each minor diameter dimension of said second tubes is smaller than each minor diameter dimension of said first tubes.

6. The heat exchanger according to claim 5, wherein said first and second tubes have major diameter center lines corresponding to each other in the air-flowing direction.

7. The heat exchanger according to claim 6, wherein:

both said first and second tubes has a distance therebetween, in the air-flowing direction; and the distance is equal to or smaller than 20 mm.

8. The heat exchanger according to claim 5, wherein a difference between the minor diameter dimension of each said second tube and the minor diameter dimension of each first tube is equal to or smaller than 1 mm.

9. The heat exchanger according to claim 1, wherein:

said first heat-exchanging unit is a radiator for cooling engine-cooling water of a vehicle; and said second heat-exchanging unit is a condenser for cooling refrigerant of a refrigerant cycle.

10. The heat exchanger according to claim 1, wherein:

said first heat-exchanging unit is disposed at a downstream air side from said second heat-exchanging unit linearly in the air-flowing direction;

in the overlapping portion, air after passing through said first heat-exchanging unit passes through said second heat-exchanging unit; and in the non-overlapping portion, air directly passes through said second heat-exchanging unit while bypassing said first heat-exchanging unit.

11. The heat exchanger according to claim 1, wherein said first tubes and said second tubes are disposed in parallel with each other.

12. A heat exchanger comprising:

a first heat-exchanging unit for performing heat exchange between a first fluid and air, said first heat-exchanging unit includes a first core portion having a plurality of first tubes through which said first fluid flows, and a plurality of first corrugated fins disposed between adjacent first tubes, and a first tank portion disposed to communicate with said first tubes, at both longitudinal ends of each said first tube;

a second heat-exchanging unit for performing heat exchange between a second fluid and air, said second heat-exchanging unit includes a second core portion having a plurality of second tubes through which said second fluid flows and a plurality of second corrugated fins disposed between adjacent said second tubes, said second tubes extending in a direction parallel to said first tubes, and a second tank portion disposed to communicate with said second tubes, at both longitudinal ends of each said second tube; and a side plate disposed in parallel with said first and second tubes at an end of said first and second core portions, for reinforcing said first and second core portions, wherein each said first corrugated fin has a first fin height between adjacent first tubes, different from a second fin height of each second corrugated fin between adjacent second tubes.

13. The heat exchanger according to claim 12, wherein:

said first tubes have a first distance between adjacent first tubes at centers of said first tubes;

said second tubes have a second distance between adjacent second tubes at centers of said second tubes, said second distance being equal to said first distance; and each said first tube has a tube thickness between adjacent first corrugated fins, different from a tube thickness of each said second tube between adjacent second corrugated fins.

14. The heat exchanger according to claim 12, wherein:

said side plate has a step portion between said first core portion and said second core portion; and said first core portion and said second core portion are integrated through said side plate.

15. The heat exchanger according to claim 12, further comprising a fin connection portion through which both said first and second fins are partially connected.

16. The heat exchanger according to claim 12, wherein:

said first heat-exchanging unit is disposed at a downstream air side from said second heat-exchanging unit linearly in an air-flowing direction;

each of said first and second tubes is a flat-shaped tube having a major diameter dimension in the air-flowing direction and a minor diameter dimension in a direction perpendicular to both a tube longitudinal direction and the air-flowing direction; and each minor diameter dimension of said second tubes is smaller than each minor diameter dimension of said first tubes.

17. The heat exchanger according to claim 16, wherein said first and second tubes have major diameter center lines corresponding to each other in the air-flowing direction.

18. The heat exchanger according to claim 16, wherein a difference between the minor diameter dimension of each said second tube and the minor diameter dimension of each first tube is equal to or smaller than 1 mm.

19. The heat exchanger according to claim 12, wherein:

said first heat-exchanging unit is a radiator for cooling engine-cooling water of a vehicle; and said second heat-exchanging unit is a condenser for cooling refrigerant of a refrigerant cycle.

20. A heat exchanger comprising:

a first heat-exchanging unit for performing heat exchange between a first fluid and air, said first heat-exchanging unit includes a plurality of first tubes through which said first fluid flows; and a second heat-exchanging unit for performing heat exchange between a second fluid and air, said second heat-exchanging unit includes a plurality of second tubes through which said second fluid flows, where:

said first heat-exchanging unit is disposed at a downstream air side from said second heat-exchanging unit linearly in an air-flowing direction;

each of said first and second tubes is a flat-shaped tube having a major diameter dimension in the air-flowing direction and a minor diameter dimension in a direction perpendicular to both a tube longitudinal direction and the air-flowing direction;

each minor diameter dimension of said second tubes is smaller than each minor diameter dimension of said first tubes; and each of said first tubes has a major diameter centerline corresponding to a major diameter centerline of each of said second tubes, said first tubes have a tube pitch equal to a tube pitch of said second tubes.

21. The heat exchanger according to claim 20, wherein the major diameter center lines of said first and second tubes correspond to each other in the air-flowing direction.

22. The heat exchanger according to claim 21, wherein:

both said first and second tubes has a distance therebetween, in the air-flowing direction; and the distance is equal to or smaller than 20 mm.

23. The heat exchanger according to claim 20, wherein a difference between the minor diameter dimension of each said second tube and the minor diameter dimension of each first tube is equal to or smaller than 1 mm.

24. The heat exchanger according to claim 20, wherein:

said first heat-exchanging unit is a radiator for cooling engine-cooling water of a vehicle; and said second heat-exchanging unit is a condenser for cooling refrigerant of a refrigerant cycle.

25. The heat exchanger according to claim 20, wherein each of said first and second tubes has an oval sectional shape.

* * * * *